US009539638B2

(12) United States Patent
McGuire et al.

(10) Patent No.: US 9,539,638 B2
(45) Date of Patent: Jan. 10, 2017

(54) MODULAR CASTING SPRUE ASSEMBLY

(71) Applicant: WiSys Technology Foundation, Inc., Madison, WI (US)

(72) Inventors: Daniel Scott McGuire, Oregon, WI (US); Eric Ernst Hellstrom, Tallahassee, FL (US)

(73) Assignee: WISYS Technology Foundation, Inc., Madison, WI (US)

( * ) Notice: Subject to any disclaimer, the term of this patent is extended or adjusted under 35 U.S.C. 154(b) by 0 days.

(21) Appl. No.: 13/735,778

(22) Filed: Jan. 7, 2013

(65) Prior Publication Data

US 2014/0190650 A1 Jul. 10, 2014

Related U.S. Application Data

(60) Provisional application No. 61/583,947, filed on Jan. 6, 2012.

(51) Int. Cl.
*B22C 9/04* (2006.01)
*B22C 9/08* (2006.01)

(52) U.S. Cl.
CPC ..... *B22C 9/046* (2013.01); *B22C 9/04* (2013.01); *B22C 9/082* (2013.01)

(58) Field of Classification Search
None
See application file for complete search history.

(56) References Cited

U.S. PATENT DOCUMENTS

| | | | | |
|---|---|---|---|---|
| 3,165,799 | A | | 1/1965 | Watts |
| 3,835,913 | A | * | 9/1974 | Vandemark et al. ..... 164/35 |
| 4,019,559 | A | | 4/1977 | Szabo |
| 4,026,344 | A | | 5/1977 | Greskovich |
| 4,432,798 | A | | 2/1984 | Helferich et al. |
| 4,581,068 | A | | 4/1986 | Schramm |
| 4,673,023 | A | * | 6/1987 | Winston ..... 164/246 |
| 4,689,081 | A | | 8/1987 | Watts |
| 4,721,149 | A | * | 1/1988 | Hesterberg et al. ..... 164/244 |
| 5,147,830 | A | | 9/1992 | Banerjee et al. |
| 5,391,606 | A | | 2/1995 | Doles |
| 5,735,336 | A | * | 4/1998 | Oti ..... 164/516 |
| 6,013,125 | A | | 1/2000 | Quraishi et al. |
| 6,375,692 | B1 | | 4/2002 | Manwiller et al. |
| 6,551,396 | B1 | | 4/2003 | Pineda et al. |
| 6,814,131 | B2 | | 11/2004 | Vandermeer |
| 7,278,465 | B1 | | 10/2007 | McGuire et al. |
| 2006/0081350 | A1 | | 4/2006 | Batio et al. |
| 2011/0232857 | A1 | | 9/2011 | McGuire et al. |

FOREIGN PATENT DOCUMENTS

| | | | | |
|---|---|---|---|---|
| EP | 668117 | A2 | * | 8/1995 |
| GB | 2358824 | A | * | 8/2001 |
| JP | 01278935 | A | * | 11/1989 |
| JP | 02137641 | A | * | 5/1990 |

* cited by examiner

*Primary Examiner* — Kevin E Yoon
*Assistant Examiner* — Jacky Yuen
(74) *Attorney, Agent, or Firm* — Boyle Fredrickson, S.C.

(57) ABSTRACT

A prefabricated sprue assembly provides attachment to independently-produced investment casting molds to substantially reduce the need for pattern material. Installable connections between the prefabricated sprue assembly and the investment mold allow substantial reduction of scrap loss caused by errors in production of individual investment molds by culling defective molds before installation to the sprue assembly.

9 Claims, 2 Drawing Sheets

MODULAR CASTING SPRUE ASSEMBLY

CROSS REFERENCE TO RELATED APPLICATION

This application claims the benefit of U.S. Provisional 61/583,947 filed Jan. 6, 2012 and hereby incorporated by reference.

BACKGROUND OF THE INVENTION

The present invention relates to a method of investment casting and in particular to an investment casting system that reduces the amount of pattern material required for the sprue for investment casting.

In investment casting for metals or other materials, a pattern may be made of a volatilizable material such as wax or plastic duplicating the desired cast part. Multiple such patterns may be attached to a sprue providing an inverted tree-like structure of the same volatilizable material having one pattern attached to the end of each branch. The patterns and the sprue are then encased in a flowable mold material, for example, a ceramic material which hardens to form a ceramic shell around the pattern and sprue.

The mold material is heated to melt and volatize the pattern and sprue leaving a hollow central channel with tubular branches leading to cavities corresponding to each pattern (also termed sprues). A casting material, for example molten metal, may then be poured down the central channel to pass to the branches into each of the cavities. When a casting material has hardened, the mold material is removed and the cast parts separated from the sprue.

The pattern material used for the sprue can be relatively expensive and sometimes heavy, thus making handling cumbersome. Because the pattern material for the sprue is ultimately burned out, the pattern material needed to produce the sprue creates additional air pollution. The flowable mold material used for making the mold cavity, selected for strength and for preserving the fidelity of the pattern, may be suboptimal for forming the sprue in terms of weight, strength and cost.

SUMMARY OF THE INVENTION

The present invention provides a modular sprue system in which the central channel and branches of the sprue are prefabricated as a hollow manifold using a manufacturing technique other than investment casting (for example, molding, machining, vacuum forming, extrusion and the like). This approach reduces the amount of volatilizable material in the molding process and may further reduce the cost of the molding process by using less expensive refractory materials for the prefabricated sprue than is used around the patterns.

Specifically, the present invention provides a modular molding system having a sprue trunk with walls constructed of a hardened refractory material and defining a passageway open at an upper end and closed at a lower end, the walls further including a plurality of openings extending laterally therethrough. A multiplicity of hollow connectors constructed of a hardened refractory material are also provided, each connector having walls defining a passageway through the connector between opposed first and second ends of the connector. At least the first end of the connector is sized to attach to one of the openings to be retained therein and to provide a continuous passage from the channel to the second end.

It is thus a feature of at least one embodiment of the invention to provide for a prefabricated sprue assembly to generally improve the workflow of investment casting.

The mold system may further include a multiplicity of plugs constructed of a hardened refractory material sized to attach to one of the openings to be retained therein and to block a passage through the opening.

It is thus a feature of at least one embodiment of the invention to permit construction of a standard sprue system that may be used in different applications requiring different numbers of mold cavities.

The mold system may further include a funnel having an upwardly flaring channel communicating with the open upper end of the passageway.

It is thus a feature of at least one embodiment of the invention to provide a sprue assembly with improved channeling of molten metal into the tree.

The second end of the hollow connector may attach to a mold constructed of a hardened refractory material passing in part around the second end adhering to the same and having an opening to receive the hollow connector.

It is thus a feature of at least one embodiment of the invention to provide a simple method of attaching a prefabricated sprue system to a mold by using the natural adhesion of the molding material.

The hardened refractory material of the mold may be different from the hardened refractory material of the hollow connector, and more generally the various components of the sprue assembly as pre-manufactured may be constructed of different materials.

It is thus a feature of at least one embodiment of the invention to allow the use of refractory materials better tailored to the particular demands of the sprue versus the mold in terms of lightness, strength and cost.

The hollow connector may be fitted into the openings by interference fit, for example a taper fit.

It is thus one feature of at least one embodiment of the invention to provide a method of assembling prefabricated and hence hardened refractory materials to produce a sprue system. This interference fit may be augmented with adhesive materials.

The bottom of the sprue trunk may provide a surface stably supporting the sprue trunk on a horizontal surface with the passageway oriented vertically.

It is thus a feature of at least one embodiment of the invention to produce a mold tree that is self-supporting in a proper orientation.

The sprue trunk may be a tube having a circular or square cross-section.

It is thus a feature of at least one embodiment of the invention to provide a sprue tree with minimized wall areas for a given sprue volume to reduce sprue metal, refractory material and cooling through the walls to preserve the sprue as a source of makeup metal during cooling.

The hollow connectors may be cylindrical tubes.

It is thus a feature of at least one embodiment of the invention to provide branch connectors that may be readily fabricated, for example, using extrusion or the like.

More generally, the invention also provides a method of molding comprising the steps of pre-fabricating a sprue assembly with a sprue trunk having walls defining a passageway and having a plurality of ports disposed in the walls and having a plurality of tubular elements each attachable to at least one of the ports. First ends of the tubular elements may be attached to patterns of a volatilizable material and coated with a refractory material integrally attached to the tubular element. Second ends of the tubular elements may then be attached to the ports in the sprue trunk and a molten casting material introduced through an upper opening of the sprue trunk, a molten material to flow through the sprue trunk, through the tubular elements, and into the molds.

It is thus a feature of at least one embodiment of the invention to permit a simplified creation of molding cavities requiring a coding only of the pattern and a portion of the tubular element.

The method may include the step of volatilizing the pattern before assembly of the sprue trunk and tubular elements.

It is thus a feature of at least one embodiment of the invention to permit removal of the pattern material from the mold before the mold is attached to the central sprue such as may allow for improved orientation during pattern removal or the like.

In one embodiment the patterns may be different volatilizable materials and the step of volatilizing the pattern may include different steps associated with the different volatilizable materials.

It is thus a feature of at least one embodiment of the invention to permit different pattern materials to be used with possibly different pattern removal steps in a single casting tree.

The method may include the step of attaching the tubular elements to the sprue trunk by refractory adhesive.

It is thus a feature of at least one embodiment of the invention to permit secure attachment of prefabricated sprue elements together using both mechanical and adhesive means.

These particular objects and advantages may apply to only some embodiments falling within the claims and thus do not define the scope of the invention.

DETAILED DESCRIPTION OF THE PREFERRED EMBODIMENT

Figure 1:
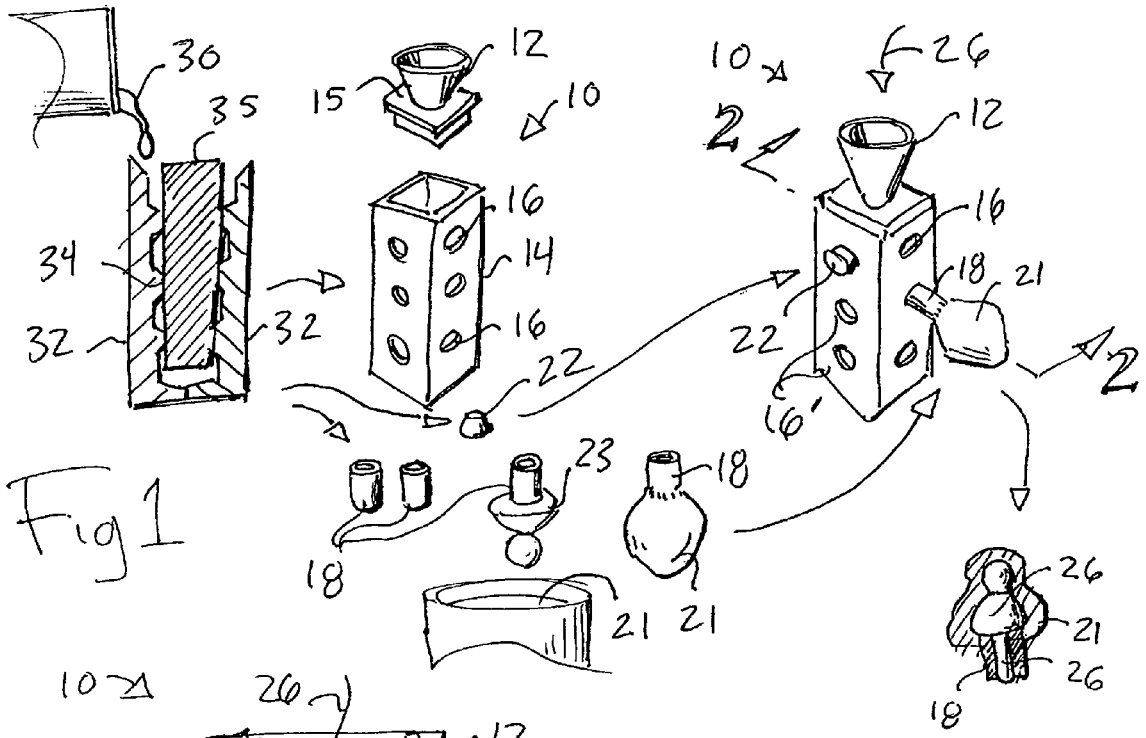
FIG. 1 is a simplified diagrammatic flowchart of a process of producing a prefabricated sprue assembly per the present invention showing a central hollow sprue trunk and multiple insertable hollow connectors providing sprue branches or plugs attached to conventionally formed shells around pattern materials.
Figure 2:
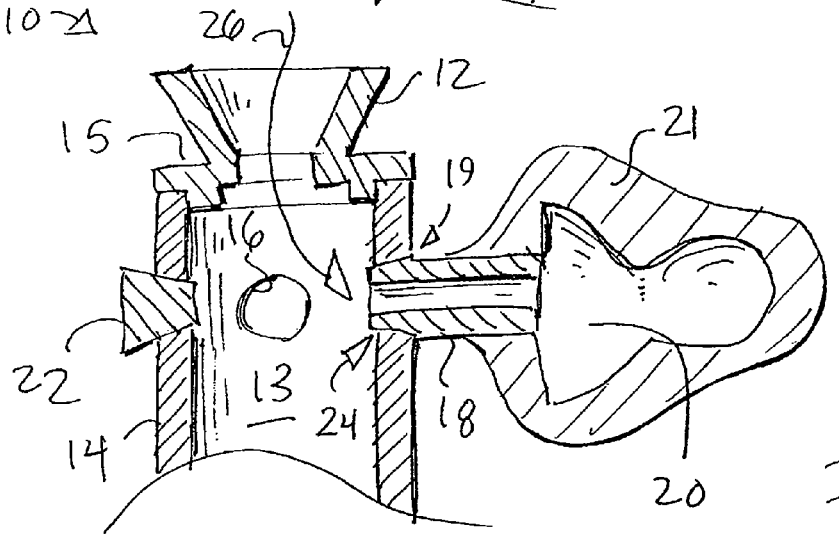
FIG. 2 is a cross-section along line 2-2 of FIG. 1 of an alternative embodiment providing a sprue trunk.

Referring now to FIGS. 1 and 2, a prefabricated sprue assembly 10 may provide for an upwardly and outwardly flaring funnel element 12 having a central passageway communicating with the interior channel 13 of a sprue trunk 14, the latter extending generally vertically downward from the funnel element 12. The sprue trunk 14 may comprise a hollow rectangular parallelpiped (as shown in FIG. 1) or a hollow cylinder (as shown in FIG. 2) or other shapes, in each case providing a closed volume except for the inlet channel of the funnel element 12 and a series of vertically displaced openings or ports 16 in the outer walls thereof. The flaring funnel element 12 may join to the sprue trunk 14 by means of a lid plate 15 attached to the bottom of the funnel element 12 (for example by refractory adhesive) and adapted to be received at an open top of the sprue trunk 14 to communicate material poured into the funnel element 12 through the funnel element 12 into the sprue trunk 14.

Each of the ports 16 may be joined with a tubular branch element 18 that may be attached to a mold cavity 20 to provide a passageway from the sprue trunk 14 into the mold cavity 20. Each mold cavity 20 is defined by a hollow shell material 21, for example a ceramic material, previously enrobing a volatilizable pattern 23 which has been removed during a volatilizing step as will be described below. The tubular branch elements 18 may be attached to the mold cavity 20 by a hardening of the material of the hollow shell material 21 around one end of a branch element 18 during an enrobement of the pattern 23. The opposite end of the branch element 18 may join to one of the ports 16 by means of a preformed socket 19 which may present a wedging taper engagement producing interference fit optionally augmented by refractory adhesive material 24. Other mechanical attachment methods such as threads or spline-type interfaces are also contemplated. While the tubular branch element 18 is shown as cylindrical, it will be appreciated that other cross-sections may also be used including square, polygonal, triangular and the like.

Unused ports 16' may be capped with plugs 22 having a similar outer diameter and form to the corresponding ends of the tubular branch elements 18 and attached by similar means but having no interior channel thereby blocking the egress of a molten casting material 26 through the port 16' and out of the sprue assembly 10.

Once the prefabricated sprue assembly 10 is assembled to the mold cavities 20, molten casting material 26 may be introduced through the funnel element 12 to pass into the hollow center of the sprue trunk 14 and through the tubular branch elements 18 into each of the mold cavities 20. Typically the casting material is a molten metal such as aluminum, bronze, brass, steel, iron or other metal material or alloy. The volume of the sprue trunk 14 is sized to maintain a liquid state of the casting material and sufficient pressure head to allow replenishment of the casting material into the mold cavities 20 during shrinkage of the casting material as it cools within the mold shells 12.

Each of the above mentioned elements of the prefabricated sprue assembly 10 (excluding the pattern 23) is formed of a high temperature refractory material retaining strength at a temperature suitable for the desired molten casting material 26. Generally, the material of the prefabricated sprue assembly 10 may differ from the material of the hollow shell material 21 so that each may be optimized to its different purpose.

Referring now to FIG. 2, the prefabricated sprue assembly 10 may be produced well in advance of construction of the patterns 23 or its enrobement in shell material 21. In this regard, the prefabricated sprue assembly 10 may be formed by a wide variety of different manufacturing techniques not practical for forming of the shell material 21. For example, as depicted, a castable liquid refractory material 30 may be introduced into a conventional and reusable mold having outer mold portions 32 (for example, one for each wall of the sprue trunk 14 of FIG. 1). In this example, the outer mold portions 32 may include plug cores 34 forming the wedge-shaped ports 16 with respect to a central removable core 35 defining the channel 13. By employing a reusable mold, the cost and waste of pattern material is eliminated. Other methods of prefabrication can also be contemplated including extrusion, with a subsequent coring of the ports 16 and the addition of a bottom plate and top funnel element 12 which may be pre-molded separately, slab construction, 3-D printing, stamping, machining from solid material, and the like. The formed material may then be baked or dried as appropriate to produce a hardened refractory.

Referring still to FIG. 2, in the example of a fabrication of the prefabricated sprue assembly 10 by molding, a separately molded funnel element 12 may be installed and attached with refractory adhesive. Similar molding or extrusion techniques may be used to manufacture the tubular branch elements 18 and the plug 22. Again, these elements may harden by drying or by kiln firing. Numerous prefabricated sprue assembly 10 and separate tubular branch elements 18 and plugs 22 may be prefabricated and stocked and/or shipped to a casting foundry from a central location that may obtain economies of scale.

When a prefabricated sprue assembly 10 is to be used, an unattached branch element 18 may be attached to a pattern 23, for example, the latter constructed of wax, polymer foam, or other well-known pattern material. This attachment may make use of a material suitable for the pattern 23, for example an attachment to a wax pattern through the use of molten wax. The assembled pattern 23 and branch element 18 may then be enrobed in shell material 21, for example, by a dipping or spraying process. Some possible enrobement techniques are described in U.S. patent application Ser. No. 12/892,550 filed Sep. 28, 2010, and U.S. Pat. No. 7,278,465 issued Oct. 9, 2007, both hereby incorporated by reference. The shell material 21 may provide for a physical attachment to the branch element 18 that resists leakage of molten metal material therethrough.

The remaining end of the branch element 18 exposed from the shell material 21 may then be fit within one of the ports 16. This process may be repeated for multiple assemblies of shell material 21 surrounding pattern 23 and attached to tubular elements 18. Each of the ports 16 may thus be filled or a subset of the ports filled and the remaining ports 16' filled with plugs 22. This attachment process may be augmented with refractory adhesive.

In one embodiment of the invention, the entire assembly may then be heated to dewax/burn out the pattern 23 and to preheat the assembly for the receipt of casting material 26 as has been described.

In an alternative embodiment using a pattern 23 made from wax, each of the assemblies of casting shell material 21 and branch elements 18 may be dewaxed by first heating the shell material 21 to allow a wax pattern material to run out and be recovered for reuse. This may be followed by a burn out. This approach allows the casting shell material 21 to be oriented for improved pattern material recovery and allows more convenient individual handling and the use of smaller ovens and the like. This approach further allows casting in one session using a single tree with a plurality of molds created with different pattern materials that may require different dewaxing/burnout procedures.

It will be appreciated that the modular nature of attaching the shell material 21 and tubular elements 18 to the tree structure of the sprue assembly 10 help moderate the problems of localized damage to one pattern which instead of producing scrap, may simply be removed and replaced with a different pattern. In this way scrap costs are reduced particularly with respect to the cast material.

Generally the refractory material used for production of the prefabricated sprue assembly 10 and its components may be different from that used to produce the shell material 21 because of the availability of different fabrication techniques or simply to accommodate the different demands for these different applications. For similar reasons, the prefabricated sprue assembly 10 and its components need not be fabricated at the foundry site but may be readily mass-produced at a remote location for sale to multiple foundries. This latter technique may save storage space at the foundry and allow just-in-time purchase of prefabricated sprue assemblies 10. Even in a case where the prefabricated sprue assembly 10 may be fabricated using investment casting, substantially different and more cost-effective and less polluting material for the pattern 23 may be used.

The embodiment described provides one that may stably rest on the floor of the foundry on the substantially planar flat bottom, however the invention is not limited to this configuration.

The refractory materials used for fabrication of the prefabricated sprue assembly 10 may, for example, be fire clays or other ceramic of the type used for manufacture of firebrick or the like. Generally suitable refractory materials may meet ASTM C71 but in any case will be those that retain their strength and integrity at high temperatures needed for the casting materials 26.

The separation of the material for the shell material 21 from the material used for the prefabricated sprue assembly 10 allows the latter to be a lighter weight and possibly more frangible material. Seams or stress points to allow easy breaking apart of the prefabricated sprue assembly 10 may be incorporated for improved recycling of these materials at the conclusion of the casting.

Figure 3:
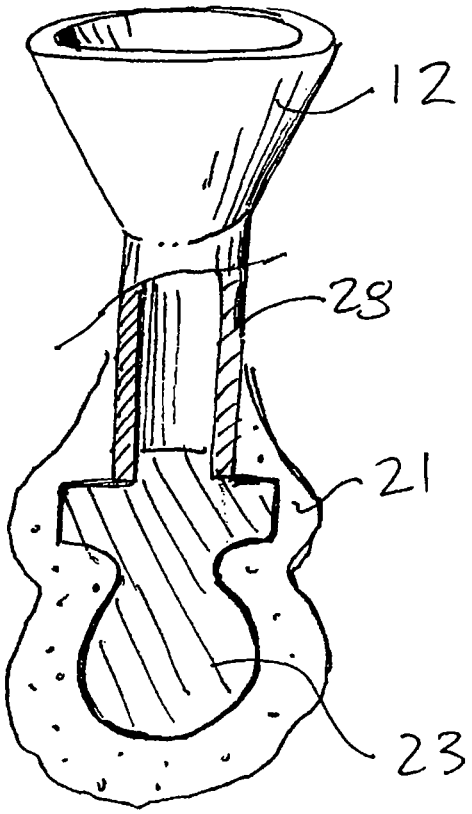
FIG. 3 is a partial cross-section of an alternative embodiment showing a central hollow sprue trunk attached to a single conventionally formed shell around a pattern material.

Referring now to FIG. 3, although it will be appreciated that the above-described embodiment provides for a sharing of the funnel 12 and sprue trunk 14 with multiple connector elements 18 branching to different patterns 23, in another embodiment, a single funnel element 12 and integrally attached reservoir/connector 28 may be prefabricated by any of the means described above to be attached to a single pattern 23. In this embodiment, a free end of the reservoir/connector 28 may be dipped in refractory material to form the shell 21 which adheres to an outer surface of the end of the reservoir/connector 28. The assembly may then be inverted to reclaim the wax of the pattern 23 by heating and then burned out and used directly to cast a single part. The reservoir/connector 28 will generally be sized to provide for sufficient volume of casting material to make up for shrinkage losses during the molding process and to maintain liquidity of the casting material in the reservoir/connector 28 during that time. In individual castings of this type, pattern material normally used to form the passageways provided by the funnel element 12 and reservoir/connector 28 may comprise the majority of the pattern material. Accordingly this approach substantially reduces use of wax or similar pattern material and pollution generated by its removal.

Generally, the material of the reservoir/connector 28 may have a rough and or porous outer surface to assist in connection to the material of the shell 21 and is pre-hardened to support the fluid shell material as it solidifies. The materials of the reservoir/connector 28 and the shell 21 should otherwise be compatible, for example, with respect to thermal expansion so that they retain connection during the heating and casting process, but need not be and typically will not be the same materials, with the material of the shell 21 optimized for preservation of detail, flowability, and removability, while the material of the reservoir/connector 28 is optimized for different manufacturing techniques (such as extrusion, vacuum forming etc.). The same considerations apply to the connectors 18.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

What we claim is:

1. A modular molding system comprising:

a sprue trunk having substantially consistent width walls defining an interior volume and constructed of a hardened refractory material to provide a passageway open at an upper end and closed at a lower end, the walls further including a plurality of preformed openings extending laterally therethrough, wherein each preformed opening is defined by an opening surface formed within a width of the wall of the sprue trunk; and a multiplicity of preformed hollow branch connectors constructed of a hardened refractory material having outer surfaces and inner walls, the inner walls defining a passageway through the connectors between opposed first and second ends of the connectors, the outer surfaces of the second ends of the connectors engaging the opening surfaces in the sprue trunk in an interference fit between the outer surface and opening surface to form mechanical attachments to the plurality of preformed openings in the sprue trunk, forming fluid tight seals between the sprue trunk and connectors and continuous channels in fluid communication from the passageway of the sprue trunk to the first end of the connectors, a refractory shell material coating a pattern and a length of the outer surface at the first end of the connector forming an attachment between the pattern and the connector, and wherein a length of the outer surface of the connectors at a portion of the second end adjacent the preformed opening in the sprue trunk is exposed to atmosphere.

2. The modular molding system of claim 1 further including a multiplicity of plugs constructed of a hardened refractory material sized to attach to one of the openings to be retained therein and to block a passage through the opening.

3. The modular molding system of claim 1 further comprising:

a funnel having an upwardly flaring channel communicating with the open upper end of the passageway.

4. The modular molding system of claim 1 wherein the refractory shell material coating the pattern and the first end of the hollow connector is hardened and forms a mold wherein the hardened refractory material of the mold is different from the hardened refractory material of the hollow connector.

5. The modular molding system of claim 1, wherein the hollow connectors are fitted into the openings by a tapered interference fit.

6. The modular molding system of claim 1, wherein the bottom of the sprue trunk provides a surface stably supporting the sprue trunk on a horizontal surface with the passageway oriented vertically.

7. The modular molding system of claim 1 wherein the sprue trunk is a tube having a cross-section selected from the group consisting of a circular cross-section and a square cross-section.

8. The modular molding system of claim 1, wherein the hollow connectors are cylindrical tubes.

9. A modular molding system comprising:

a preformed sprue trunk having substantially consistent width walls defining an interior volume and constructed of a hardened refractory material to provide a passageway open at an upper end and closed at a lower end, the walls further including a plurality of openings extending laterally therethrough, wherein each preformed opening is defined by an opening surface formed within a width of the wall of the sprue trunk; and a multiplicity of preformed hollow branch connectors constructed of a hardened refractory material having outer surfaces and inner walls, the inner walls defining a passageway through the connectors between opposed first and second ends of the connectors, the outer surfaces of the second ends of the connectors engaging the opening surfaces in the sprue trunk in a tapered interference fit between the outer surface and opening surface to form mechanical attachments to the plurality of openings in the sprue trunk, forming fluid tight seals between the sprue trunk and connectors and continuous channels in fluid communication from the passageway of the sprue trunk to the first end of the connectors, a ceramic shell surrounding a pattern extending from each of the multiplicity of hollow branch connectors, the shells including a hardened refractory material adhered to an outer surface of the pattern and a length of the outer surface at the first end forming an attachment between the pattern and the connector, and wherein a length of the outer surface of the connectors at a portion of the second end adjacent the preformed opening in the sprue trunk is exposed to atmosphere when the connectors are mechanically attached to the plurality of openings in the sprue trunk while maintaining fluid tight seals between the sprue trunk and connectors.

* * * * *